United States Patent [19]

Finke

[11] Patent Number: 4,492,073

[45] Date of Patent: Jan. 8, 1985

[54] BITTING RIG APPARATUS FOR TRAINING HORSES

[76] Inventor: Scott C. Finke, 7171 Eagan Dr., Savage, Minn. 55378

[21] Appl. No.: 492,377

[22] Filed: May 6, 1983

[51] Int. Cl.[3] ..... B68B 1/00

[52] U.S. Cl. ..... 54/35; 54/70

[58] Field of Search ..... 54/6 A, 16, 14, 17, 54/24, 35, 70, 71

[56] References Cited

U.S. PATENT DOCUMENTS 434,421 8/1890 Blaikie ..... 54/35

1,532,853 4/1925 Aguilar ..... 54/24

FOREIGN PATENT DOCUMENTS 9824 of 1889 United Kingdom ..... 54/70

*Primary Examiner*—Robert P. Swiatek

[57] ABSTRACT

A bitting rig apparatus (10) for training horses is disclosed. A preferred embodiment of the bitting rig apparatus (10) includes an elongated, flexible member (12), the member (12) being releasably attached at its ends to a saddle (14) on a horse on opposite sides of the horse. A ring-like member (18) is slideably positioned on the elongated member (12) for slideable movement therealong. A second elongated member (20) extends through the ring-like member, the ends of the second member (20) being releasably attached to shanks (24) at opposite ends of a bit (26) positioned in the horse's mouth.

4 Claims, 2 Drawing Figures

FIG. 1
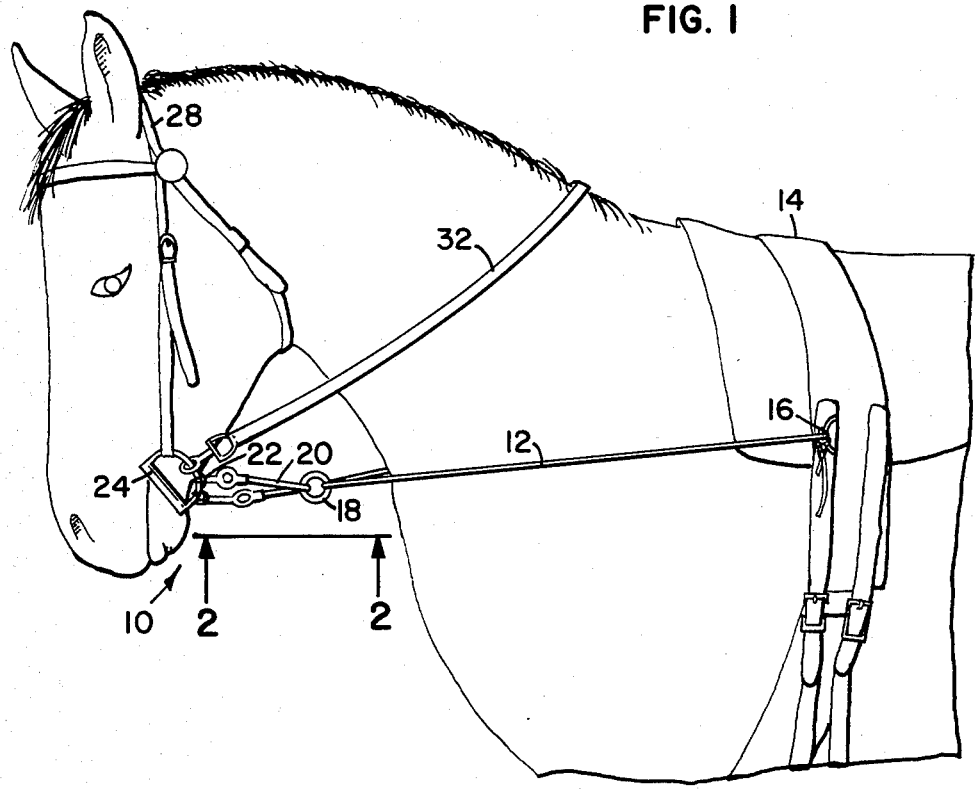
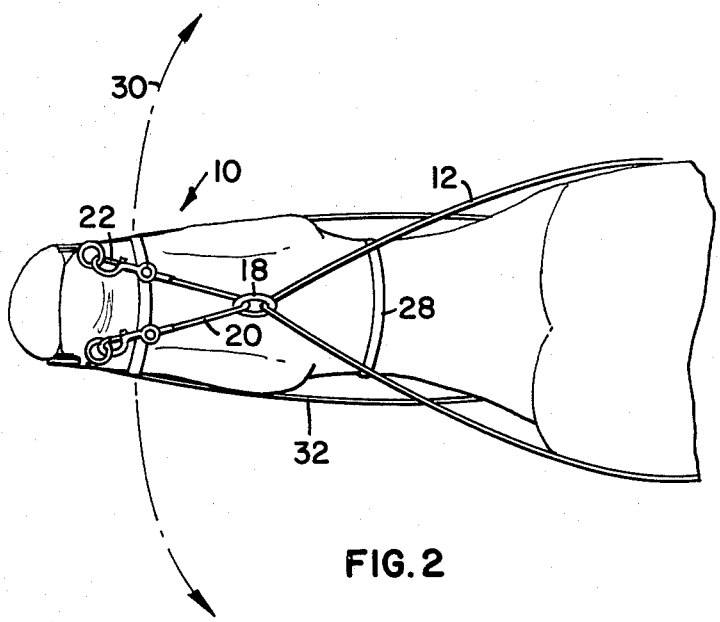
FIG. 2

BITTING RIG APPARATUS FOR TRAINING HORSES

The present invention relates to a bitting rig apparatus for training a horse to arch or "set" its head by conditioning the horse to move its head in response to pressure exerted by the bit of the bitting rig positioned in the horse's mouth.

There are several bitting rigs currently available. Many of these apparatus are fairly complicated, involving pulleys and special bridles.

The most common bitting rig is referred to by the trade name "side checks". The "side checks" bitting rig comprises two adjustable rubber straps with a snap on each end. One end of the straps is fastened to a ring on the saddle or a curcingle on each side of the horse, the other end of the straps being fastened to the shank of the bit in the horse's mouth. The "side checks" device will teach a horse to set its head looking straight on but when the horse tries to flex its neck or turn its head to the side, it will receive an increased pressure point on the side of its mouth opposite the direction of the turn. This in effect punishes the horse for flexing its neck to the side or being "supple", a desirable trait of a saddle horse.

The present invention solves these and many other problems associated with currently available bitting rig apparatus for training horses.

SUMMARY OF THE INVENTION

The present invention relates to a bitting rig apparatus for training horses. The bitting apparatus comprises an elongated, flexible member which is releasably attached at its ends to a saddle or the like on a horse on opposite sides of the horse. A ring-like member is slideably positioned on the elongated member for slideable movement theralong. A second elongated, flexible member extends through the ring-like member and is releasably attached at the ends thereof to a shank portion at opposite ends of a bit positioned in the horse's mouth, the second member being substantially shorter than the first memeber.

A particularly advantageous feature of the present invention is that the bitting rig apparatus does not restrict a horse from turning its head to the side whereby a horse trained properly with the bitting rig apparatus of the present invention will be more supple than horses trained with devices such as the "side checks" apparatus.

Another particularly advantageous feature of the present invention is that a signal can be taught to the horse to vary its head set when one end of the first elongated member is pulled or released by the trainer.

Furthermore, the presemt invention is easy to use and properly position on the horse. Furthermore, the present invention has relatively few working parts as compared to some apparatus which utilize rather complicated pulleys and special bridles. As a result, the present invention is relatively inexpensive and has a relatively long useful life.

When used properly, the present invention provides for humanely training horses in such a manner that the horse will properly set its head while still being supple and having a light mouth. These are all desireable characteristics of good saddle horses. In addition, the present invention can be utilized for harness horses also.

Furthermore, the present invention does not require special equipment usch as special bridles and con be used while riding a horse, which is not true of many training apparatus currently available.

In addition, the present invention provides for varying the levels of control in training. For example, the second elongated member may be made from a non-resilient material whereby the horse receives a relatively abrupt training command if it attempts to pivot its head upward. The second elongated member might also comprise a resilient material such that there is some give in the bitting rig apparatus thereby reducing somewhat the severity of the head "set" commands when the horse attempts to pivot its head out of position. It will be appreciated, that the present invention might provide for many varying levels of training commands.

In addition, the present invention is readily released from the saddle thereby facilitating teaching of the head "set" signal.

These and various other advantages and features of novelty which characterize the invention are pointed out with particularity in the claims annexed hereto and forming a part hereof. However, for a better understanding of the invention, its advantages, and objects attained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals indicate corresponding parts throughout the several views, FIG. 1 is a view in perspective of a preferred embodiment of the present invention suitably positioned for use on a horse;

FIG. 2 is a view generally along line 2—2 of FIG. 1.

DETAILED DESCRIPTION OF A PREFERRED EMBODIMENT

Referring now to the drawings, there is shown in FIGS. 1 and 2 a preferred embodiment of the present invention, generally referenced by numberal 10. As illustrated by the preferred embodiment, the present invention is a bitting rig apparatus utilized to train a horse to arch or "set" its head. In addition, the present invention may be utilized to give head "set" signals to the horse whereby the horse will vary its "set". As illustrated, the present invention includes as elongated flexible cord approximately four feet in length which is releasably attached at its ends to a saddle or curcingle on opposite sides of the horse. Preferably, the elongated member 12 is a flexible member relatively non-resilient. It will be appreciated that the length of the elongated flexible member 12 will vary somewhat depending on the size of the horse and its attachment points at the side of the horse. However, the elongated member is preferably configured such that when placed in tension as generally illustrated in FIGS. 1 and 2, the elongated member is displaced from the horse's neck. Additionally, the elongated member 12 is preferably attached at location 16 on the saddle 14 by a slip knot or the like which is readily releasable, thereby enabling the elongated member to be readily removed and head "set" signals to be given to the horse.

Slideably positioned on the elongated member 12 is a ring-like member 18. Preferably, the ring-like member 18 is relatively rigid and large enough to ensure freedom of movement along the elongated member 12.

Extending through the ring-like member 18 is a second elongated member 20 which is releasably fastened at the ends therof to the head of the horse. As illustrated, this is preferably accomplished by utilizing swivel snap members 22 to attach the elongated member 20 to bit shanks 24 at the end of a bit in the horse's mouth.

As illustrated, the present invention may be utilized with a conventional bridle comprising a head stall 28 and the bit.

The second elongated member 20 is preferably much shorter than the first elongated member 12, with the preferred embodiment having a length of approximately four to six inches. This assures that the ring-like member 18 is located relatively close to the horse's head thereby facilitating sliding movement of the ring-like member 18 on the elongated member 12. As illustrated in FIG. 2 by the broken arrowed lines 30, the present invention provides the horse with freedom of movement to either side while causing the horse to maintain a predetermined head "set". As illustrated in FIG. 1, the present invention restrains the horse from movement of its head clockwise in a vertical plane while providing for relative freedom of movement in a horizontal plane as illustrated by the broken arrowed lines 30 in FIG. 2.

It will be appreciated that the present invention can be modified to enable varying degrees of control or severity of punishment for the horse flexing its head at the pole and not maintaining a proper head "set". For example, in one embodiment of the present invention, the elongated member 20 might be made from a relatively resilient material such as rubber tubing. Accordingly, as the horse flexes its head, the pressure applied by the bit in the horse's mouth will be somewhat gradual due to the resilient nature of the elongated member 20. Accordingly, the control commands to this horse will take on a somewhat less severe character. In yet other embodiments of the present invention, the elongated member 20 might be made from a flexible, substantially non-resilient material such as leather. Accordingly, when the horse attempts to pivot its head out of the head "set", the pressure, and therefore the signal, imparted by the bit on the horse's mouth will be more immediate and direct thereby resulting in a greater degree of severity.

It is to be understood, however, that even though numerous advantages and characteristics of the invention have been set forth in foregoing description, together with details of the structure and function of the invention, the disclosure is illustrative only, and changes may be made in detail, especially in matters of shape, size and arrangement of parts within the principal of the invention, to the full extent indicated by the broad general meaning of the terms in which the appended claims are expressed.

What is claimed is:

1. A bitting rig apparatus for training horses, comprising:

(a) an elongated flexible member, said member being releasably attached at its ends to a saddle or the like on a horse on opposite sides of the horse, and extending about the outside of the horse's legs, said elongated member being configured such that when placed in tension, an intermediate portion of said elongated member is displaced forwardly of and apart from the horse's neck, the length of the elongated flexible member between its ends of attachment to the saddle being readily adjustable;

(b) a ring-like member slideably positioned on said elongated member for slideable movement therealong; and, (c) a second elongated, resilient flexible member extending through said ring-like member, the ends of said second member being releasably attached to a shank portion at opposite ends of a bit positioned in the horse's mouth, said second elongated member being substantially shorter than said first elongated member, the second elongated resilient flexible member cooperating with the elongated flexible member when in tension to cause the horse's neck to flex an adjustable predetermined amount at its poll location.

2. A bitting rig apparatus in accordance with claim 1, wherein said first elongated, flexible member is non-resilient.

3. A bitting rig apparatus in accordance with claim 1, wherein said first and second elongated, flexible members lie in the same general plane.

4. A method of training a horse to set its head using a bitting rig apparatus to cause the horse's neck to flex a predetermined amount at its poll location comprising the steps of:

(a) providing an elongated flexible member, the member being releasably attached at its ends to a saddle or the like on a horse on opposite sides of the horse, the elongated member being configured such that when placed in tension, a portion of the elongated member is displaced forwardly of and apart from the hores's neck;

(b) slideably positioning a ring-like member on the elongated member for slideable movement therealong; and (c) extending a second elongated, resilient flexible member through the ring-like member, the ends of the second member being releasably attached to a shank portion at opposite ends of a bit positioned in the horse's mouth, the second elongated member being substantially shorter than the first elongated member.

* * * * *